US011696668B1

(12) United States Patent
Ferguson et al.

(10) Patent No.: US 11,696,668 B1
(45) Date of Patent: Jul. 11, 2023

(54) SEMI-AUTOMATIC WARE WASHING SPRAYER SYSTEM

(71) Applicant: Insinger Machine Co., Philadelphia, PA (US)

(72) Inventors: Mark A. Ferguson, Rockvale, TN (US); Lewis Heayns, Philadelphia, PA (US); Matthew Smith, Bristol, PA (US); James S. Calhoun, Corbin, KY (US)

(73) Assignee: Insinger Machine Co., Philadelphia, PA (US)

( * ) Notice: Subject to any disclaimer, the term of this patent is extended or adjusted under 35 U.S.C. 154(b) by 141 days.

(21) Appl. No.: 17/381,848

(22) Filed: Jul. 21, 2021

Related U.S. Application Data

(63) Continuation of application No. 16/267,316, filed on Feb. 4, 2019, now Pat. No. 11,096,550.

(51) Int. Cl.

| | |
|---|---|
| ***A47L 15/00*** | (2006.01) |
| ***A47L 15/44*** | (2006.01) |
| ***A47L 15/46*** | (2006.01) |
| ***A47L 15/42*** | (2006.01) |

(52) U.S. Cl.
CPC ..... *A47L 15/449* (2013.01); *A47L 15/0065* (2013.01); *A47L 15/4223* (2013.01); *A47L 15/46* (2013.01)

(58) Field of Classification Search
None
See application file for complete search history.

(56) References Cited

U.S. PATENT DOCUMENTS

| | | | | |
|---|---|---|---|---|
| 2,665,440 | A * | 1/1954 | Starcevich | A47L 15/0065 134/55 |
| 3,092,120 | A * | 6/1963 | Huger | A47L 15/0086 134/55 |
| 5,762,096 | A * | 6/1998 | Mirabile | B08B 9/0325 134/169 C |
| 6,276,373 | B1 * | 8/2001 | Gotfried | A47L 15/0065 134/171 |
| 9,226,642 | B1 | 1/2016 | Becknell | |
| 9,596,972 | B2 | 2/2017 | Sonoda | |

(Continued)

OTHER PUBLICATIONS

FR 3038214A3 translation, Zabala, Machine for Rinsing Glasses (Year: 2017).*

(Continued)

*Primary Examiner* — Cristi J Tate-Sims
(74) *Attorney, Agent, or Firm* — Mei & Mark, LLP

(57) ABSTRACT

A control box for a sprayer system is provided. The control box may include a wash flow path, a wash flow solenoid disposed in the wash flow path, a detergent supply assembly disposed in wash flow path, a rinse flow path, a rinse flow solenoid disposed in the rinse flow path, a common flow path, a flow switch disposed in the common flow path, an alternating relay, and a connection valve leading to a discharge flow path. The flow switch may be configured to provide a signal to the alternating relay. The alternating relay may be configured to control both the wash flow solenoid and the rinse flow solenoid. The connection valve may receive both the wash flow path and the rinse flow path. In another embodiment, a sprayer system including a control box and a sprayer unit is provided.

20 Claims, 8 Drawing Sheets

(56) References Cited

U.S. PATENT DOCUMENTS

| | | | | |
|---|---|---|---|---|
| 2011/0061754 | A1 | 3/2011 | Thomas | |
| 2011/0203620 | A1 | 8/2011 | Ulger | |
| 2011/0226292 | A1* | 9/2011 | Ulger | A47L 15/0015 134/198 |
| 2017/0143181 | A1 | 5/2017 | Spang | |

OTHER PUBLICATIONS

The Bar Maid System . . . the Ultimate Method for Cleaning and Sanitizing Glassware. (Date unknown).
Bar Maid Spec Sheet (2004).
Blendtec (R) Commercial, Rapid Rinser (TM) Spec Sheet (Jan. 2018).
Vitamix (R), Rinse-O-Matic (R) Spec Sheet (Oct. 2012).

* cited by examiner

SEMI-AUTOMATIC WARE WASHING SPRAYER SYSTEM

TECHNICAL FIELD

The present disclosure is directed to the technical field of dishwashing. More particularly, the present disclosure is directed to the technical field of sprayers for cleaning glasses and similar types of ware.

BACKGROUND

Conventional sprayers are used in commercial applications, for example, in restaurants and bars to rapidly rinse leftover beverage, food particles, and/or detergent from ware, such as glasses or blenders. In a typical situation, for example, behind a bar, used ware may be quickly washed with detergent and/or soaked in a detergent bath. Then, an operator may place the ware upside down upon a sprayer, such as the RAPID RINSER™ manufactured by BLEND-TEC®. Then the operator may actuate the sprayer, causing a spray of water to shoot up into the ware and thereby rinsing it and readying the ware for subsequent use.

However, conventional sprayers have several drawbacks. First, a separate washing or soaking process is often needed or desired prior to conventional sprayer use for effective cleaning. This may cause inefficiencies in the ware cleaning process or, in some instances, result in cross-contamination or otherwise inadequately cleaned ware. Accordingly, absent a separate washing step, sprayers are typically used only to rinse blender jars, glasses, milk mugs, mixed drink shakers, and other similar ware that has been used exclusively for mixing or storing. Second, conventional sprayers use only potable water for rinsing and are not designed to accommodate the use of sanitizers during the rinsing process. Accordingly, conventional sprayers may introduce a risk of cross-contamination between rinsed ware in some circumstances. Third, conventional sprayers typically have fixed nozzles, which may provide either a cone spray or a stream spray. Accordingly, conventional sprayers may inadequately rinse off debris in some circumstances.

SUMMARY OF THE DISCLOSURE

The present disclosure provides a description of systems and components thereof, as well as methods for using the same, to address the perceived problems described above and others. More particularly, the present disclosure provides a description of sprayer systems that allow for improved, semi-automatic touchless cleaning of ware, components thereof, and methods of operation.

In one embodiment, a control box for a sprayer system is provided. The control box may include a wash flow path, a wash flow solenoid disposed in the wash flow path, a detergent supply assembly disposed in wash flow path, a rinse flow path, a rinse flow solenoid disposed in the rinse flow path, a common flow path, a flow switch disposed in the common flow path, an alternating relay, and a connection valve leading to a discharge flow path. The common flow path may include an initial portion of the wash flow path and an initial portion of the rinse flow path. The flow switch may be configured to provide a signal to the alternating relay. The alternating relay may be configured to control both the wash flow solenoid and the rinse flow solenoid based on the signal. The connection valve may receive both the wash flow path and the rinse flow path.

The flow switch may be configured to send the signal to the alternating relay upon detecting a flow of water through the flow switch after a period of no flow. The alternating relay may be configured to, upon receiving the signal from the flow switch, alternate between a first state and a second state. In the first state, the rinse flow solenoid may be closed, blocking the rinse flow path. In the second state, the wash flow solenoid may be closed, blocking the wash flow path.

The control box may further include a sanitizer supply assembly. The sanitizer supply assembly may be disposed in the rinse flow path.

The sanitizer supply assembly may include an ozone generator disposed in the rinse flow path and a flow control device disposed in the rinse flow path. The flow control device may be disposed before the ozone generator in the rinse flow path. The control box may further include a rinse path check valve disposed in the rinse flow path. The rinse path check valve may be disposed after the ozone generator in the rinse flow path. The rinse path solenoid may be disposed after the rinse path check valve in the rinse flow path.

The sanitizer supply assembly may include a sanitizer suction valve disposed in the rinse flow path and a sanitizer suction tube disposed upon the sanitizer suction valve. The sanitizer suction valve may be configured to draw liquid sanitizer through the sanitizer suction tube and into the rinse flow path. The rinse path solenoid may be disposed before the sanitizer suction valve in the rinse flow path. The sanitizer supply assembly further may further include a sanitizer mixing element disposed in the rinse flow path after the sanitizer suction valve.

The control box may further include a mode indicator. The mode indicator may indicate a wash mode if the wash path solenoid is open, the rinse path solenoid is closed, and water is flowing through the flow switch. The mode indicator may indicate a rinse mode if the rinse path solenoid is open, the wash path solenoid is closed, and water is flowing through the flow switch. The mode indicator may indicate a standby mode if is water is not flowing through the flow switch. The mode indicator may include a first LED and a second LED. The mode indicator may illuminate the first LED to indicate the wash mode. The mode indicator may illuminate the second LED to indicate the wash mode.

The control box may further include an inlet check valve. The inlet check valve may be disposed in the common flow path before the flow switch.

In another embodiment, a sprayer system is provided. The sprayer system may include a control box and a sprayer unit. The control box may include a wash flow path, a wash flow solenoid disposed in the wash flow path, a detergent supply assembly disposed in wash flow path, a rinse flow path, a rinse flow solenoid disposed in the rinse flow path, a common flow path, a flow switch disposed in the common flow path, an alternating relay, and a connection valve leading to a discharge flow path. The common flow path may include an initial portion of the wash flow path and an initial portion of the rinse flow path. The flow switch may be configured to provide a signal to the alternating relay. The alternating relay may be configured to control both the wash flow solenoid and the rinse flow solenoid based on the signal. The connection valve may receive both the wash flow path and the rinse flow path. The sprayer unit may be configured to receive fluid from the discharge flow path and to expel the received fluid as a spray.

The sprayer unit may be configured to control the flow of the received fluid. A flow of water through the flow switch may correspond to the flow of received fluid.

The sprayer unit may include a mounting device, a spray lever disposed on the mounting device, and a nozzle disposed on the mounting device. The sprayer unit may be configured to expel the spray through the nozzle. The sprayer unit may be configured the control the flow of the received fluid as a function of a movement of the spray lever.

The nozzle may be a variable spray nozzle configured to expel spray in a variable spray pattern as a function of the movement of the spray lever. The variable spray pattern may be a cone spray if the movement of the spray lever is small and the variable spray pattern may be a stream spray if the movement of the spray lever is large.

The spray lever may be attached to the mounting device at a plurality of pivot points. The movement of the spray lever may be a partial rotation about an axis through the plurality of pivot points.

The sprayer unit may include a variable spray garden hose sprayer.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosure.

DETAILED DESCRIPTION

The present disclosure generally refers to sprayer system 100, which provides semi-automatic touchless cleaning of ware 32.

Figure 1A:
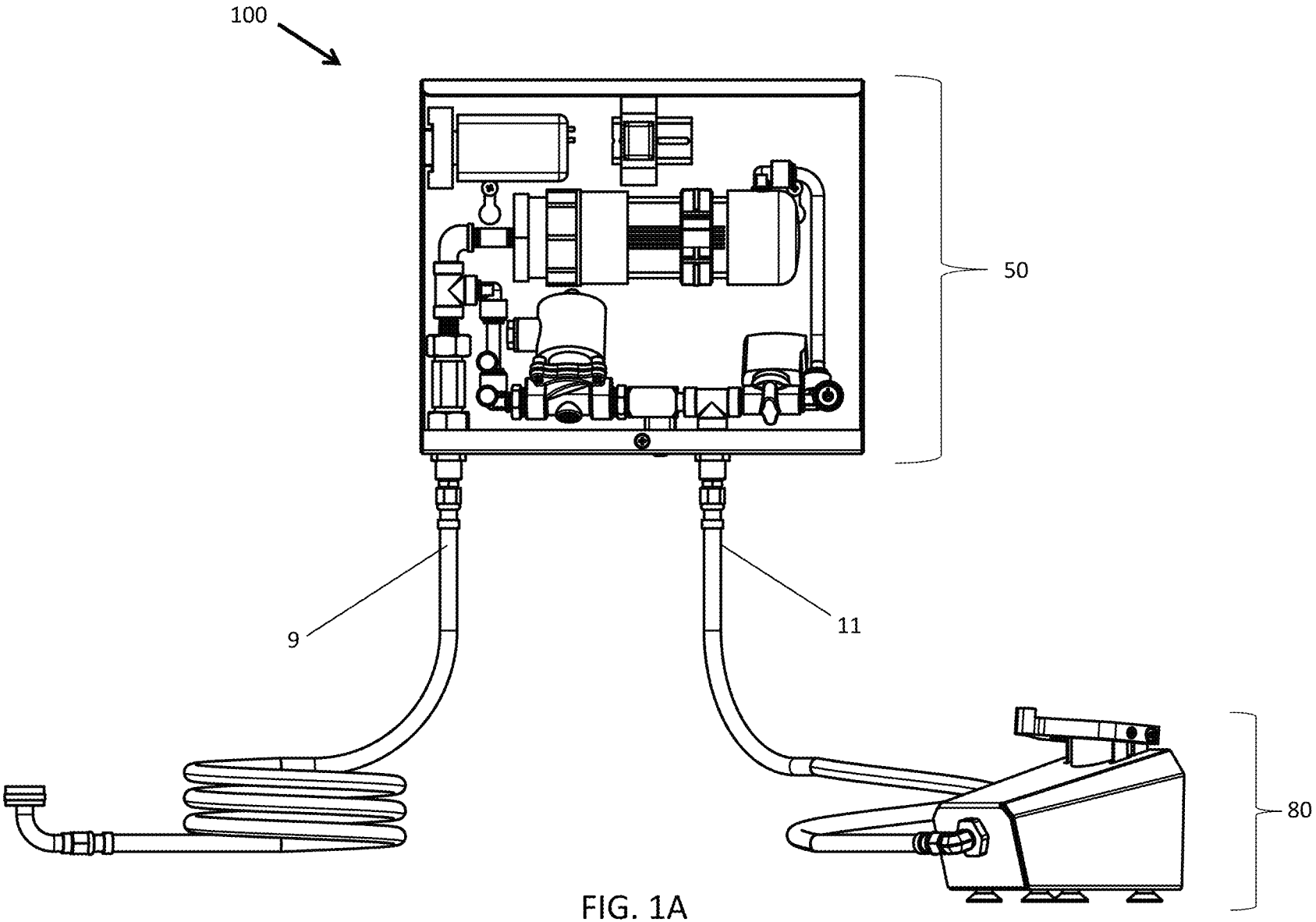
FIG. 1A is a diagram illustrating a sprayer system, according to an exemplary embodiment of the present disclosure.

With reference to FIGS. 1A, sprayer system 100 may include control box 50 and sprayer unit 80. Control box 50 may be configured to receive water—such as hot, cold, or warm tap water—through water inlet 9 and alternatively provide washing or rinsing fluids to sprayer unit 80 through discharge flow path 11. In preferred embodiments, various components, fittings, and tubing of sprayer system may be characterized by a ½ inch diameter.

Figure 2A:
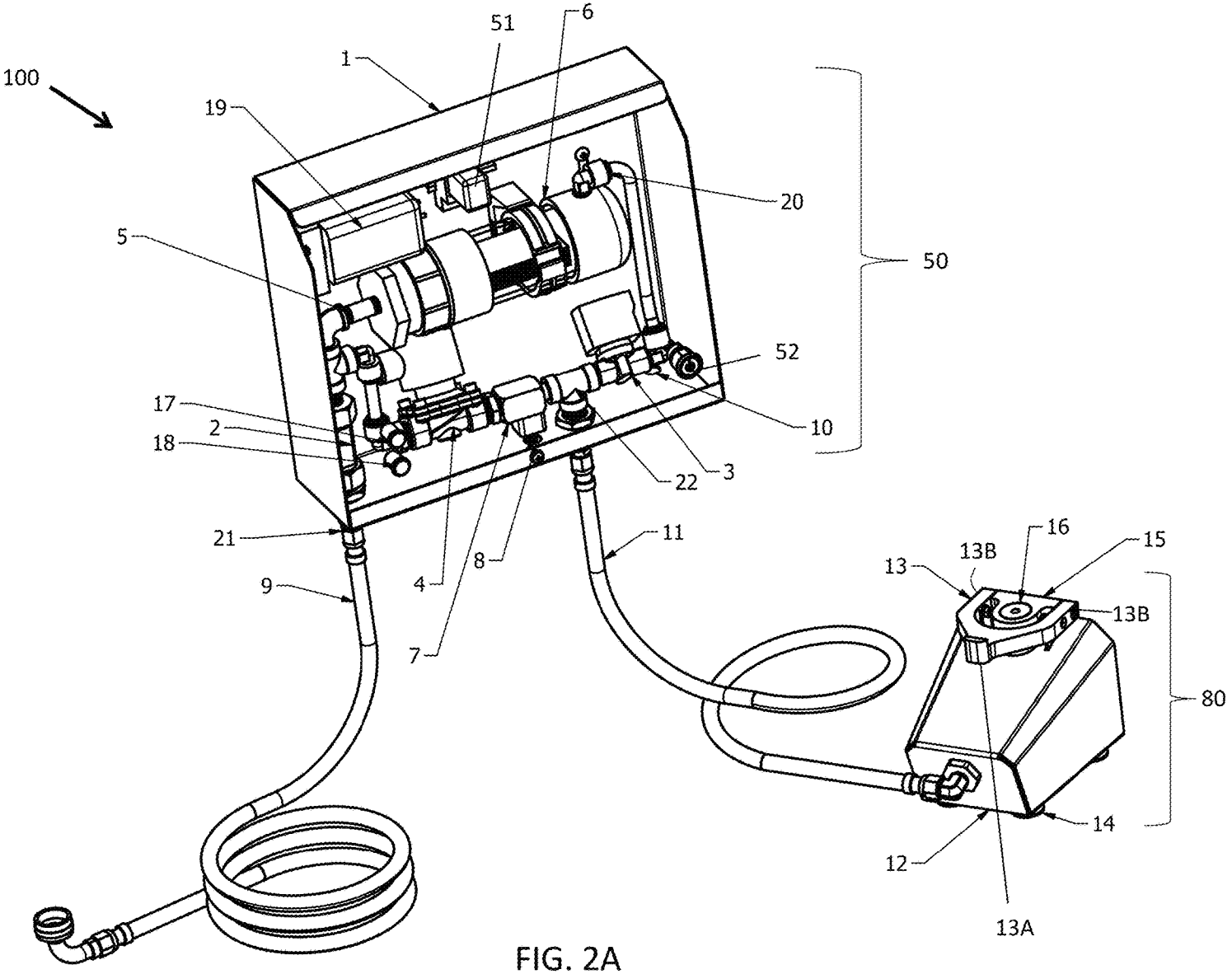
FIG. 2A is a diagram illustrating the sprayer system of FIG. 1A from a perspective view, according to an exemplary embodiment of the present disclosure.

With reference to FIG. 2A, sprayer unit 80 may include sprayer unit enclosure 12, spray lever 13, mounting device 15, nozzle 16, and suction feet 14. Ultimately, sprayer system 100 may discharge cleaning fluids through nozzle 16. Nozzle 16 may be mounted on mounting device 15, which, in turn, may be disposed on top of sprayer unit enclosure 12. In preferred embodiments, nozzle 16 may be a variable spray nozzle, for example, of the garden hose sprayer type, and may accordingly vary the type of spray expressed.

Spray lever 13 may be configured to have nozzle 16 expel spray when spray lever 13 is depressed and cease expelling fluid when pressure is removed from spray lever 13. Spray lever 13 may preferably operate analogously to the trigger lever of a variable garden hose sprayer. That is, where nozzle 16 is a variable spray nozzle, a heavy depression of spray lever 13 (e.g., complete or almost-complete actuation) may result in higher-powered stream spray and a light depression of spray lever 13 may result in as a broader cone spray. In some embodiments, the intensity of the spray released may additionally or alternatively vary, at least in some circumstances, with the amount of pressure received by spray lever 13, with the highest intensity spray being provided when spray lever 13 is fully depressed and the lowest intensity spray being provided when spray lever 13 is only slightly depressed.

Figure 2B:
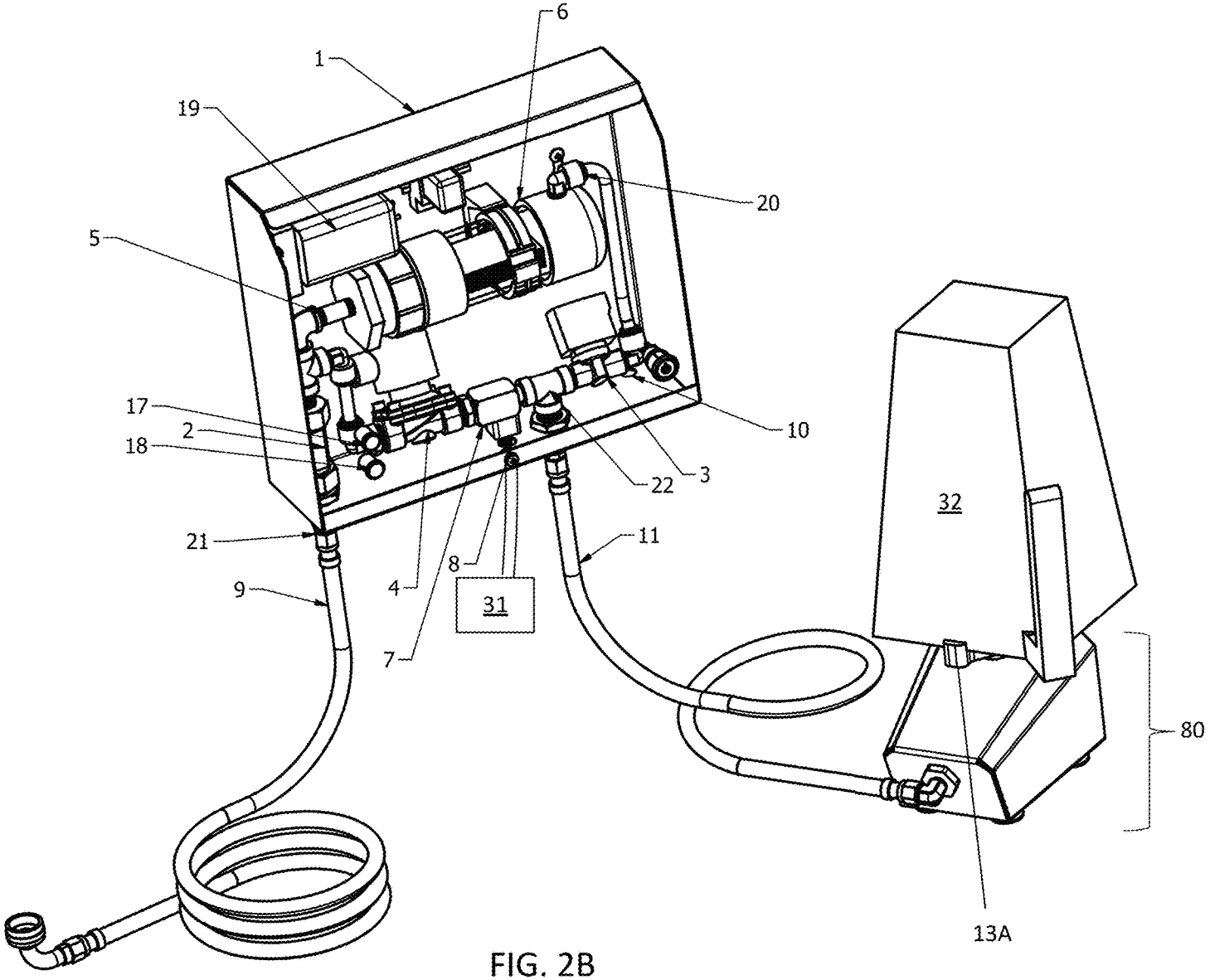
FIG. 2B is the diagram of FIG. 2A, further illustrating elements of sprayer system use, according to an exemplary embodiment of the present disclosure.

It is contemplated that an operator may depress sprayer lever 13 with ware 32 that is to be cleaned, for example, as shown in FIG. 2B. In this manner, an operator may advantageously clean ware 32 by operating sprayer system 100 without touching sprayer system 100, itself. Spray lever 13 may further include spray lever protrusion 13A, which may serve to help an operator simultaneously maintain ware 32 in a proper position during cleaning and maintain a desired pressure on spray lever 13 indirectly via pressure on ware 32. In preferred embodiments, spray lever 13 may be attached to mounting device 15 at pivot points 13B, thereby advantageously securing spray lever 13 at an end opposite from spray lever protrusion 13A and permitting its partial rotation about an axis through pivot points 13B.

In alternative embodiments, a standard garden house sprayer or the like may be mounted on mounting device 15 or the like, and may serve to accomplish the functionality of lever 13 and nozzle 16. In such embodiments, mounting device 15 may provide threading, for example garden hose threading. Further, in such embodiments, nozzle 16 may not be directly mounted on mounting device 15.

In yet other alternative embodiments, the entirety of sprayer unit 80 may be a standard garden hose sprayer or the like. In such embodiments, sprayer system 100 may be used to, for example, wash and rinse ware 32 such as plates, bowls, pots, and pans in alternating manner in a sink rather than by placing ware upside down upon sprayer unit 80, as contemplated in other embodiments.

It is contemplated that sprayer unit 80 may be positioned in a sink or supplied basin that has a drain during operation. Accordingly, suction feet 14 may serve to anchor sprayer unit 80 at an appropriate location within a cleaning environment.

Sprayer system 100 may permit an operator to perform a touchless wash using detergent and followed by a sanitizing rinse. In preferred embodiments, the operator may manipulate spray lever 13 with ware 32 to control the fluid content of spray—in addition to turning the spray on and off and controlling the type of spray (and/or its intensity), as discussed above.

Figure 1B:
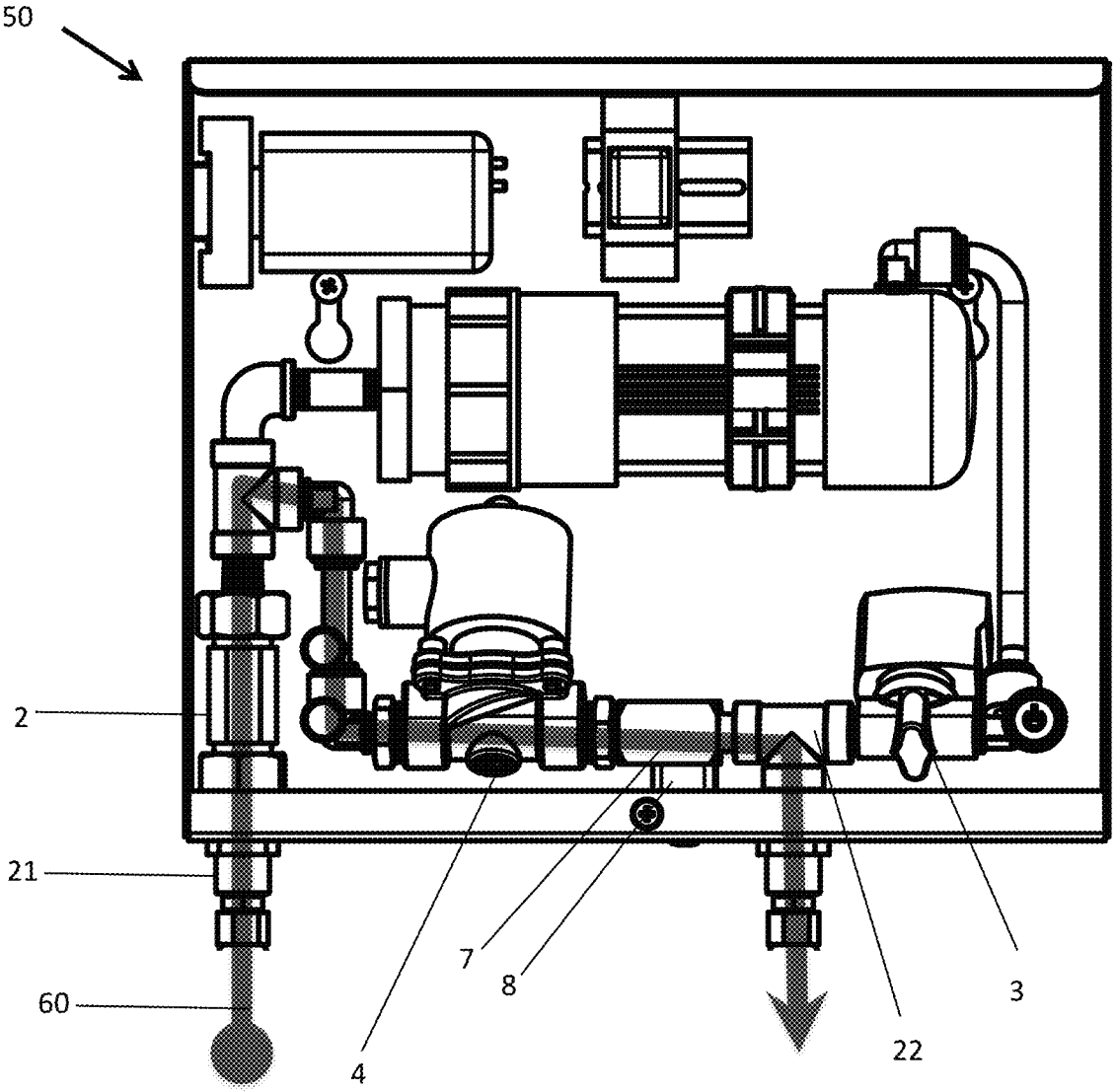
FIG. 1B is a diagram of the control box of the sprayer system of FIG. 1A, further illustrating a wash flow path, according to an exemplary embodiment of the present disclosure.
Figure 1C:
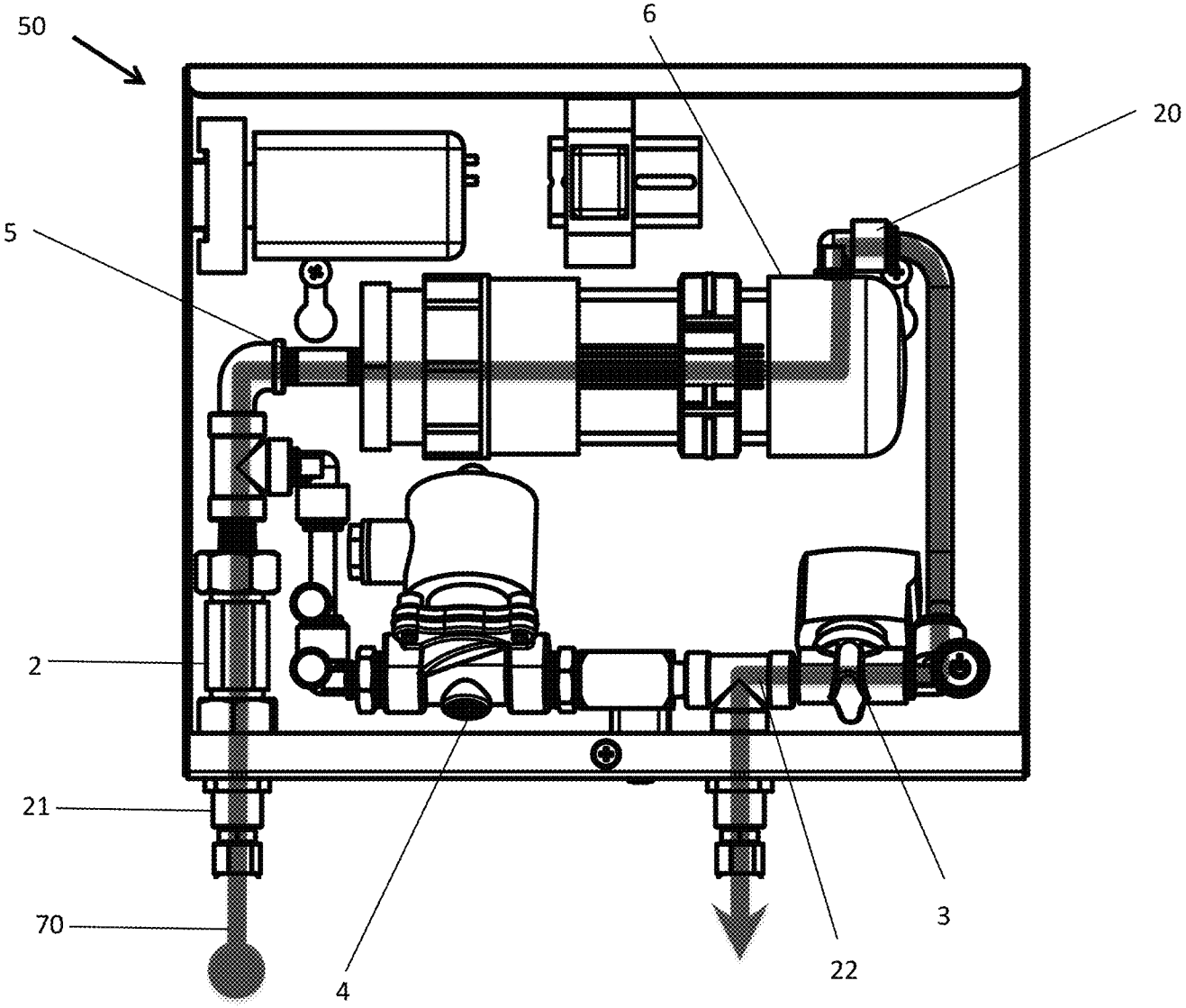
FIG. 1C is a diagram of the control box of the sprayer system of FIG. 1A, further illustrating a rinse flow path, according to an exemplary embodiment of the present disclosure.

To accomplish fluid content control, sprayer system 100 may alternatively spray washing fluid and rinsing fluid upon each separate "on" actuation of spray lever 13. As shown in FIGS. 1A and 1B, control unit 50 may provide washing fluid to sprayer unit 80 via wash flow path 60 and discharge flow path 11. As shown in FIGS. 1A and 1C, control unit 50 may provide rinsing fluid to sprayer unit 80 via rinse flow path 70 and discharge flow path 11.

With reference to FIGS. 1B-2B, control unit 100 may include control box cover 1 (shown in FIGS. 1A-4 with front portion removed for illustrative purposes), flow switch 2, rinse path solenoid 3, wash path solenoid 4, a sanitizer supply assembly, a detergent supply assembly, power input 10, a mode indicator, alternating relay 19, rinse path check valve 20, inlet check valve 21, connection valve 22, power relay 51, and on/off switch 52. When ozone is used as a sanitizer, the sanitizer supply assembly may include flow control device 5 and ozone generator 6. The detergent supply assembly may include detergent siphon valve 7 and detergent suction tube 8, which may be placed into detergent bottle 31. The mode indicator may include rinse LED 17 and wash LED 18.

Flow switch 2 is configured to detect water inflows there through—and thereby indirectly detect each separate "on" actuation of spray lever 13. Upon each detection of a new flow of water (or alternatively each distinct stoppage of water flow), flow switch 2 may provide a signal to alternating relay 19, which may be configured to control both rinse path solenoid 3 and wash path solenoid 4. Alternating relay 19 may be wired such that when rinse path solenoid 3 is closed, wash path solenoid 4 is open, placing control unit 50 in wash mode, wherein fluid may flow to sprayer unit 80 through wash flow path 60. Further, alternating relay 19 may be wired such that when rinse path solenoid 3 is open, wash path solenoid 4 is closed, placing control unit 50 in rinse mode, wherein fluid may flow to sprayer unit 80 through rinse flow path 70.

Flow switch 2 is preferably sensitive and may, in some embodiments, detect flows as small as 0.2 L/minute or smaller. In preferred embodiments, virtually any amount of initial fluid flow through flow switch 2, as may be caused by some minimal amount of pressure on spray lever 13 will be registered by flow switch 2, triggering alternating relay 19 accordingly.

Wash LED 17 may be illuminated during wash mode and Rinse LED 18 may be illuminated during rinse mode to inform the operator of the status of sprayer system 100. In some embodiments, neither rinse LED 18 nor wash LED 17 may be illuminated when control box 50 is in standby mode—e.g., where there is no fluid flow, regardless of the status of alternating relay 19. In some embodiments, standby mode may be indicated by a standby LED (not shown) to further inform the operator of the status of sprayer system 100. In preferred embodiments, rinse and wash (and standby) LEDs may be different colors. In alternative embodiments, other known electrical or mechanical visual or auditory indicator(s) may be utilized to indicate the status of sprayer system 100.

Flow switch 2, alternating relay 19, rinse path solenoid 3, wash path solenoid 4, ozone generator 6, and mode indicator may be powered via power input 10. Power relay 51 may serve to control box 50 on or off under control of on/off switch 52. (Electrical connections have been omitted from FIGS. 1A-4 to improve clarity.) The above-recited electrical components of control box 50 may preferably be powered at 12 $V_{DC}$. At 12 $V_{DC}$, control box 50 may advantageously be electrically protected with a class II transformer. However, in alternative embodiments, control box 50 may be powered at 120 $V_{AC}$, 240 $V_{AC}$, or other available power inputs.

With reference to FIG. 1B, in wash mode, water may enter control box 50 from water inlet 9 (not shown) and pass through inlet check valve 21. Inlet check valve 21 may advantageously prevent back flow of fluids from either wash flow path 60 or rinse flow path 70 into water inlet 9. Further, inlet check valve 21 may prevent or reduce unwanted bouncing of flow switch 2 that may otherwise occur due to pressure fluctuations or water hammer caused by, for example, fluid flow being abruptly stopped by a release of spray lever 13. Wash flow path 60 may then proceed through flow switch 2 and wash path solenoid 4, which may be open during wash mode.

Wash flow path 60 may continue through the detergent supply assembly. As best viewed in FIG. 2B, the flow of water may pass through detergent siphon valve 7. Accordingly, this flow may siphon detergent from detergent bottle 31 through detergent suction tube 8 and detergent siphon valve 7, pulling detergent into wash flow path 60 and mixing to create washing fluid. The washing fluid may pass through connection valve 22 and into discharge flow path 11, where it may ultimately be sprayed by sprayer unit 80. Rinse path solenoid 3, which may be closed during wash mode, may prevent the washing fluid from flowing through connection valve 22 into the rinse flow path 70 in the reverse direction.

With reference to FIG. 1C, in rinse mode, water may enter control box 50 through water inlet 9 (not shown) and pass through inlet check valve 21. Rinse flow path 70 may then proceed through flow switch 2 and continue through the sanitizer supply assembly.

The sanitizer supply assembly embodiment depicted in FIGS. 1A-2B may convert water into an aqueous ozone solution to serve as the rinsing fluid. In the depicted embodiment, ozone may be formed by electrolysis and put into solution within ozone generator 6, which may typically generate ozone at a constant rate until a certain concentration is reached. It may also be noted that for an effective aqueous ozone solution to be generated, the water flowing into ozone generator 6 should be below 100 F, and preferably around 70 F. In some embodiments, ozone generator 6 may run during rinse mode under the control of alternating relay 19; it may also run at start-up of control box 50 and/or intermittently during wash and/or standby modes.

In other embodiments, ozone generator 6 may run constantly during standby mode and rinse mode; during standby, rinse, and wash modes; or when it is switched on by a separate ozone generation switch (not shown). Although such embodiments could theoretically result in the creation of hazardous ozone levels, commercially available ozone generators best suited for this application may be unable to create an aqueous ozone solution with a concentration greater than 3 ppm, 4 ppm, or 5 ppm—even during periods where there is no flow. Accordingly, any such risks may be minimal.

Flow control device 5 may ensure a near-constant flow of water into ozone generator 6. Accordingly, flow control device 5 may ensure that sanitizing solution flowing from ozone generator 6 contains a minimum concentration of ozone that is sufficient for sanitization. In certain preferred embodiments, flow control device 5 may comprise a flow regulator, for example, part number 58.6514.1 manufactured by NEOPERL®.

After passing through the sanitizer supply assembly, rinse flow path 70 may proceed through rinse path check valve 20. Rinse path check valve 20 may advantageously prevent back flow of washing fluid backwards through rinse flow path 70, and in particular into ozone generator 6. It may also protect ozone generator 6 from potential water hammer. As would be appreciated by persons of skill in the art, rinse path check valve 20 may be placed in different locations along rinse flow path 70, or, in other embodiments removed altogether.

The rinsing fluid may then pass through rinse path solenoid 3, which is open during rinse mode. Then, rinse flow path 70 may proceed through connection valve 22 and into discharge flow path 11, where it may ultimately be sprayed by sprayer unit 80. Wash path solenoid 4, which is closed during rinse mode, may further prevent the rinsing fluid from flowing through connection valve 22 into wash flow path 60 in the reverse direction.

With reference to FIGS. 1B and 1C, it may be noted that at least an initial portion of wash flow path 60 and an initial portion of rinse flow path 70 are coextensive. Water supplied from water inlet 9 may flow into this common flow path. Further, inlet check valve 21 and flow switch 2 may be disposed in this common flow path.

Figure 3:
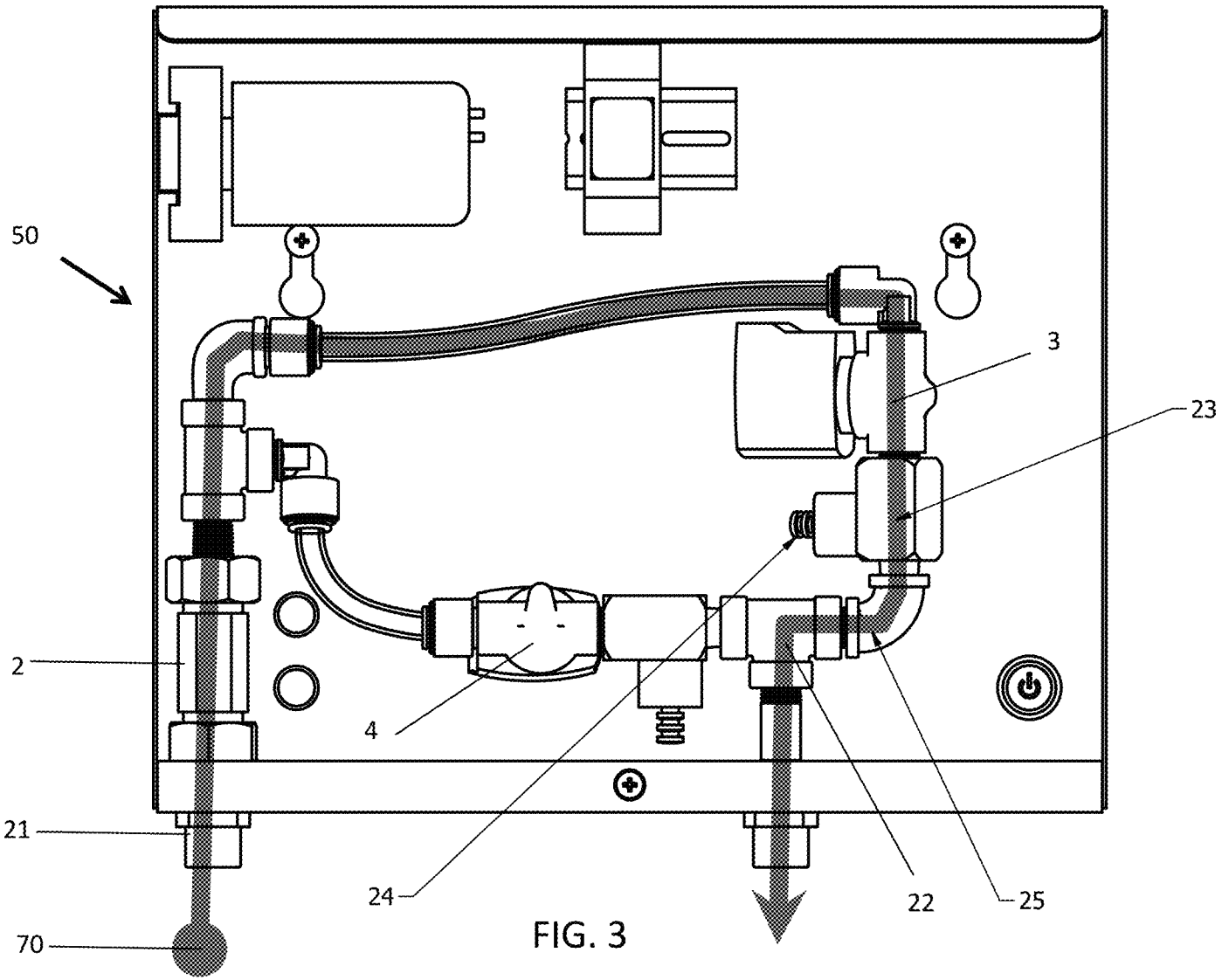
FIG. 3 is a diagram illustrating a control box of a sprayer system, further illustrating a rinse flow path, according to another exemplary embodiment of the present disclosure.

With reference to FIG. 3, in alternative embodiments, the rinsing fluid can incorporate sanitizers other than ozone, for example, liquid sanitizers known in the art—such as Quat, chlorine, iodine, and the like. In such embodiments, instead of ozone, liquid sanitizer may be mixed into water to produce rinsing fluid. Other than alterations to the sanitizer supply assembly, the embodiment of control box 50 depicted in FIG. 3, is substantially similar that depicted in FIGS. 1A-2B. Specifically, the wash flow path 60 of the embodiment of FIG. 3 may be virtually identical to that discussed above with respect to FIG. 1B.

Except for the sanitizer supply assembly, rinse flow path 70 of the embodiment of FIG. 3 is similar to that discussed above with respect to FIG. 1C. In the embodiment of FIG. 3, the sanitizer supply assembly omits ozone generator 6 and flow control device valve 5. Instead, the sanitizer supply assembly may comprise sanitizer siphon valve 23, sanitizer suction tube 24, and, optionally, sanitizer mixing element 25. Preferably, sanitizer mixing element 25 may be an elbow-shaped pipe component, but may be, for example, any piping or plumbing element known to cause mixing during flow. The rinse flow path 70 may pass through sanitizer siphon valve 23. Accordingly, this flow may siphon liquid sanitizer from a sanitizer bottle (not shown) through sanitizer suction tube 24 and sanitizer siphon valve 23, pulling liquid sanitizer into rinse flow path 70 and mixing to create rinsing fluid. Further mixing and agitation of the rinsing fluid may occur as it passes through sanitizer mixing elbow 25 en route to connection valve 22.

Further, as in the embodiment depicted in FIG. 3, rinse path check valve 20 may be omitted when liquid sanitizer is used. With flow control device valve 5 removed, inlet check valve 21 may suffice to prevent back flow through rinse flow path 70. And, water hammer may be effectively prevented by inlet check valve 21. Additionally in this embodiment, rinse path solenoid 3 may be placed before the sanitizer supply assembly in rinse flow path 70.

Figure 4:
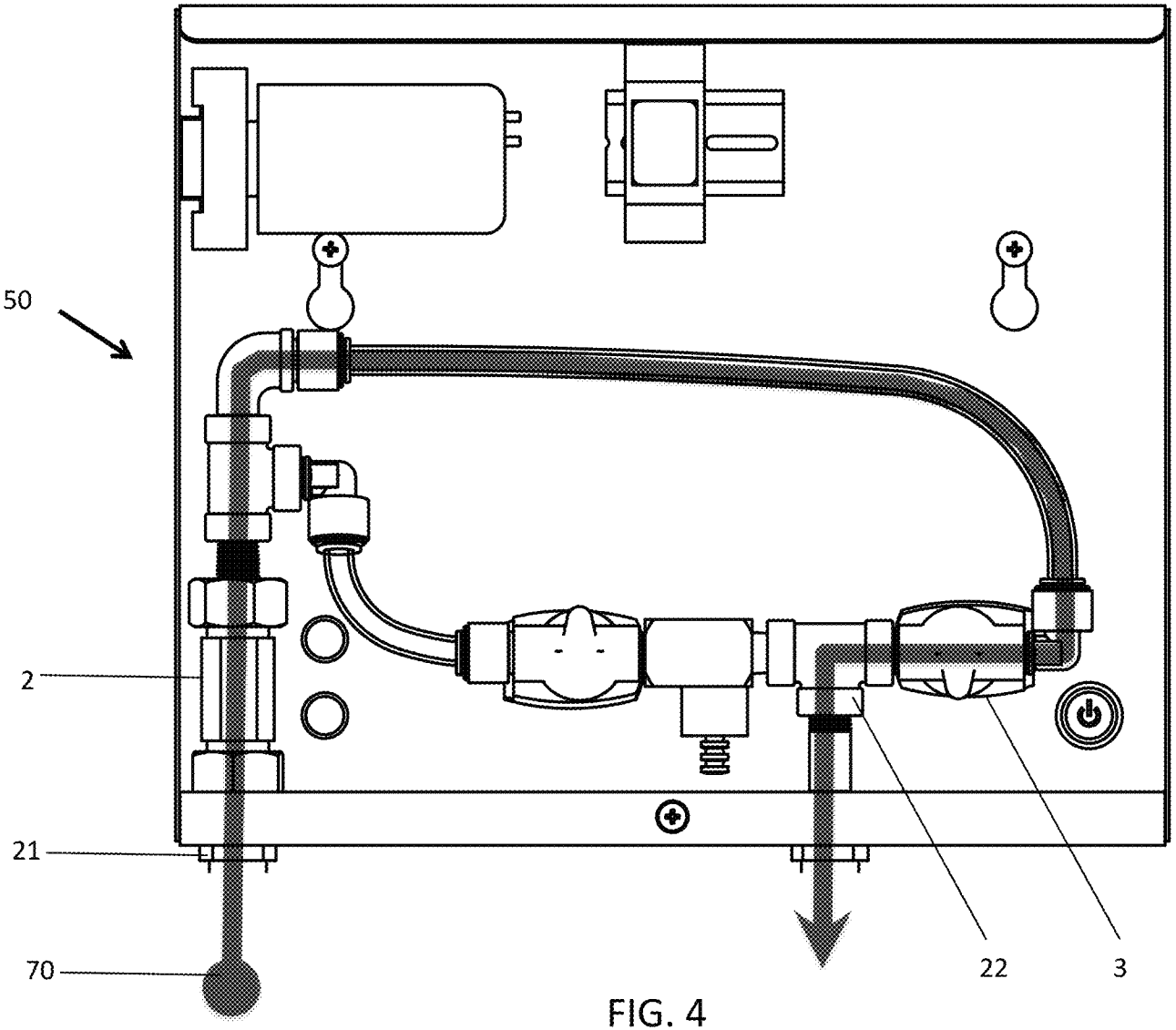
FIG. 4 is a diagram illustrating a control box of a sprayer system, further illustrating a rinse flow path, according to yet another exemplary embodiment of the present disclosure.

With reference to FIG. 4, in other alternative embodiments, the rinsing fluid may be water with no sanitizers added. In such embodiments, the sanitizer supply assembly may be omitted entirely, along with rinse path check valve 20. In such embodiments, the wash flow path 60 remains unchanged (as with the embodiment of FIG. 3), and rinse flow path 70 is further simplified.

A description of an exemplary use of sprayer system 100 illustrates its efficient semi-automatic operation: From standby mode, an operator may place ware 32 over nozzle 16 of sprayer unit 80 and depress the spray lever 13 with ware 32 to begin the flow of fluid. One of wash LED 17 or rinse LED 18 on control box 50 may illuminate, thereby indicating if the device is in wash or rinse mode. If wash mode is indicated, the operator may continue to allow washing fluid to flow; he may vary the amount lever 13 is depressed to alternate from cone spray to stream spray. If, however, rinse mode is initially indicated, the operator may raise ware 32, allowing rinsing fluid to stop flowing and placing the system in standby mode; then, the operator may place ware 32 immediately back onto lever 32 causing washing fluid to flow and entering wash mode.

After the operator visually verifies ware 32 has been sufficiently washed, he may lift ware 32 from lever 13, allowing the flow to of washing fluid to stop and entering standby mode. Then, the operator may again place ware 32 onto lever 13 and depress to begin the flow of rinsing fluid and enter rinse mode. The mode indicator may indicate that sprayer system 100 is in rinse mode. The operator may rinse ware 32; he may vary the spray pattern by varying the amount of pressure applied to lever 13. Once the operator determines that ware 32 is sufficiently rinsed, he may raise ware 32 from lever 13, allowing the flow of rinsing fluid to stop and reentering standby mode. Control unit 50 be prepared to automatically go into wash mode upon the next actuation of lever 13.

As disclosed above, sprayer system 100 may facilitate the efficient and effective cleaning of ware 32 while minimizing the risk of cross-contamination. It advantageously may enable an operator to efficiently, quickly, and easily wash with detergent followed by a sanitizing (or plain water) rinse. Further, it may support thorough washes and rinses by permitting an operator to easily and quickly vary the spray pattern and/or spray intensity.

Figure 5:
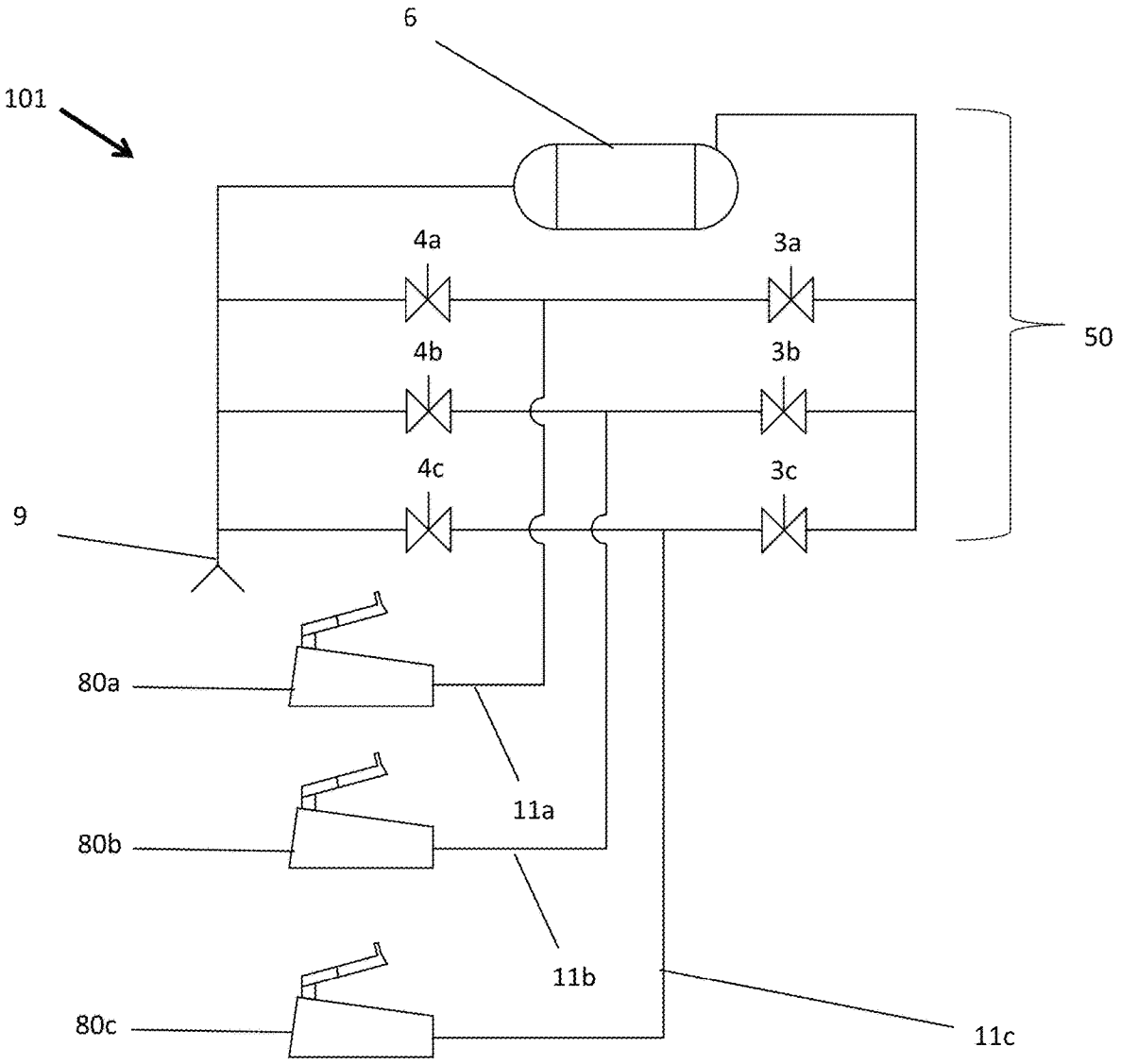
FIG. 5 is a diagram illustrating a multi-sprayer system, according to yet another exemplary embodiment of the present disclosure.

With reference to FIG. 5, multi-sprayer system 101 may support multiple sprayer units 80 through a single control box 50. It is contemplated that multi-sprayer system 101 may be utilized in larger commercial applications where multiple sprayer units 80 may be helpful. FIG. 5 depicts an embodiment of multi-sprayer system 101 with three sprayer units 80*a*, 80*b*, 80*c*, connected, respectively, to three discharge flow paths 11*a*, 11*b*, 11*c*. However in other embodiments, two, four, five, or more sprayer units and corresponding discharge flow paths may be provided and/or supported.

In multi-sprayer system 101, wash flow paths flowing into discharge flow paths 11*a*, 11*b*, 11*c*, respectively, may pass through wash path solenoids 4*a*, 4*b*, 4*c*, respectively. Similarly, rinse flow paths flowing into discharge flow paths 11*a*, 11*b*, 11*c*, respectively, may pass through rinse path solenoids 3*a*, 3*b*, 3*c*, respectively.

A single sanitizer supply assembly, here represented by ozone generator 6, may supply sanitizer for all rinse paths. However, in alternative embodiments, each rinse flow path may have its own sanitizer supply assembly or portion thereof. For example, in some embodiments, each rinse flow path may include its own respective sanitizer siphon valve 23 and suction tube 24, multiple of which may draw liquid from a shared sanitizer bottle. In yet other embodiments, some rinse flow paths may share a sanitizer supply assembly and others may have their own.

Other elements of sprayer system 100 and/or their equivalents not depicted in FIG. 5 may be included in multi-sprayer system 101, but are omitted from the drawing. For example, each wash flow path may have its own detergent supply assembly or portion thereof. For example, in some embodiments, each wash flow path may include its own respective detergent siphon valve 7 and suction tube 8, which may draw detergent their own respective detergent bottles 31*a*, 31*b*, 31*c* (not shown) or from a shared detergent bottle 31 (not shown). In other embodiments of multi-sprayer system 101, all wash flow paths may share a single detergent supply assembly positioned in a common wash flow path (not shown) before the multiple wash flow paths diverge.

Additionally, in some embodiments multi-sprayer system 101 may include a single flow switch 2 positioned in a manner similar to that of the embodiments depicted in FIGS. 1A-4. Such flow switch 2 (not shown) may provide signals to a single alternating relay 19 (not shown), which may collectively switch between closing all wash path solenoids 4*a*, 4*b*, 4*c* and closing all rinse path solenoids 3*a*, 3*b*, 3*c*.

In other embodiments, multi-sprayer system 101 may include a separate flow switch for each discharge flow path 11*a*, 11*b*, 11*c*. For example, such flow switches 2*a*, 2*b*, 2*c* (not shown) may be positioned after their respective connection valves 22*a*, 22*b*, 22*c* (not shown) and prior to discharge flow paths 11*a*, 11*b*, 11*c*. Each flow switch 2*a*, 2*b*, 2*c* may provide signals, respectively, to a corresponding alternating relay 19*a*, 19*b*, 19*c* (not shown). In turn, alternating relay 19*a* may control wash path solenoid 4*a* and rinse path solenoid 3*a*; alternating relay 19*b* may control wash path solenoid 4*b* and rinse path solenoid 3*b*; and alternating relay 19*c* may control wash path solenoid 4*c* and rinse path solenoid 3*c*. Under such embodiments, it is contemplated that multiple discharge flow paths 11*a*, 11*b*, 11*c* may be simultaneously active, with one (or more) in wash mode and other(s) in rinse mode. Additionally, multi-sprayer system 101 may include a mode indicator that indicates which of the multiple wash or rinse flow paths are active.

Although the foregoing embodiments have been described in detail by way of illustration and example for purposes of clarity of understanding, it will be readily apparent to those of ordinary skill in the art in light of the description herein that certain changes and modifications may be made thereto without departing from the spirit or scope of the appended claims. It is also to be understood that the terminology used herein is for the purpose of describing particular aspects only, and is not intended to be limiting, since the scope of the present invention will be limited only by the appended claims.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only," and the like in connection with the recitation of claim elements, or use of a "negative" limitation. As will be apparent to those of ordinary skill in the art upon reading this disclosure, each of the individual aspects described and illustrated herein has discrete components and features which may be readily separated from or combined with the features of any of the other several aspects without departing from the scope or spirit of the disclosure. Any recited method can be carried out in the order of events recited or in any other order that is logically possible. Accordingly, the preceding merely provides illustrative examples. It will be appreciated that those of ordinary skill in the art will be able to devise various arrangements which, although not explicitly described or shown herein, embody the principles of the disclosure and are included within its spirit and scope.

Furthermore, all examples and conditional language recited herein are principally intended to aid the reader in understanding the principles of the invention and the concepts contributed by the inventors to furthering the art, and are to be construed without limitation to such specifically recited examples and conditions. Moreover, all statements herein reciting principles and aspects of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary configurations shown and described herein.

In this specification, various preferred embodiments have been described with reference to the accompanying drawings. It will be apparent, however, that various other modifications and changes may be made thereto and additional embodiments may be implemented without departing from the broader scope of the claims that follow. The specification and drawings are accordingly to be regarded in an illustrative rather than restrictive sense.

We claim:

1. A method for cleaning soiled ware, the method comprising:

placing the soiled ware upside down upon a sprayer with a spray lever;

pressing the spray lever with the soiled ware a first time to initiate a flow of washing fluid into the soiled ware;

washing the soiled ware with the flow of washing fluid such that the soiled ware becomes washed ware;

releasing the spray lever a first time to halt the flow of washing fluid;

pressing the spray lever with the washed ware a second time to initiate a flow of rinsing fluid into the washed ware;

rinsing the washed ware with the flow of rinsing fluid such that the washed ware becomes cleaned ware;

releasing the spray lever a second time to halt the flow of rinsing fluid; and removing the cleaned ware from the sprayer.

2. The method of claim 1 further comprising:

providing, as the washing fluid, water mixed with detergent.

3. The method of claim 1 further comprising:

providing, as the rinsing fluid, an aqueous ozone solution.

4. The method of claim 1 further comprising:

providing, as the rinsing fluid, water mixed with Quat, chlorine, or iodine.

5. A method of operating a ware washer, the method comprising:

detecting a first water inflow via a flow switch of the ware washer;

providing washing fluid to a discharge flow path of the ware washer through a wash flow path of the ware washer upon the first detected water inflow, the wash flow path being a route taken by water from a water inlet to the discharge flow path;

halting the provision of washing fluid by blocking the discharge flow path;

detecting a halt of the first water inflow via the flow switch;

detecting a second water inflow via the flow switch;

providing rinsing fluid to the discharge flow path through a rinse flow path of the ware washer upon the second detected water inflow, the rinse flow path being a route taken by water from the water inlet to the discharge flow path that is not coextensive with the wash flow path; and halting the provision of rinsing fluid by blocking the discharge flow path; and detecting a halt of the second water inflow via the flow switch.

6. The method of claim 5, wherein:

the step of providing washing fluid to the discharge flow path further comprises closing the rinse flow path; and the step of providing rinsing fluid to the discharge flow path further comprises closing the wash flow path.

7. The method of claim 5, wherein:

the step of providing washing fluid to the discharge flow path further comprises illuminating a wash LED of the ware washer; and the step of providing rinsing fluid to the discharge flow path further comprises illuminating a rinse LED of the ware washer.

8. The method of claim 7, further comprising:

turning off the wash LED upon detecting the halt of the first water inflow; and turning off the rinse LED upon detecting the halt of the second water inflow.

9. The method of claim 8, further comprising:

illuminating a standby LED of the ware washer if neither the wash LED nor the rinse LED are illuminated.

10. The method of claim 5, wherein:

the step of providing washing fluid to the discharge flow path further comprises mixing, within the wash flow path, detergent with first water inflow.

11. The method of claim 5, wherein:

the step of providing rinsing fluid to the discharge flow path further comprises running the second water inflow through an ozone generator of the rinse flow path.

12. The method of claim 5, wherein:

the step of providing rinsing fluid to the discharge flow path further comprises mixing, within the rinse flow path, a sanitizer with the second water inflow.

13. The method of claim 5, wherein:

blocking the discharge flow path further comprises releasing a spray lever of a sprayer of the ware washer.

14. The method of claim 5, wherein:

the step of providing washing fluid to the discharge flow path further comprises opening the discharge flow path; and the step of providing rinsing fluid to the discharge flow path further comprises opening the discharge flow path.

15. The method of claim 14, wherein:

opening the discharge flow path further comprises pressing a spray lever of a sprayer of the ware washer.

16. The method of claim 15, wherein:

the step of pressing the spray lever further comprises pressing the spray lever with ware.

17. A method of operating a ware washer, the method comprising:

detecting a first water inflow via a flow switch of the ware washer;

providing washing fluid to a discharge flow path of the ware washer through a wash flow path of the ware washer upon the first detected water inflow;

halting the provision of washing fluid by blocking the discharge flow path;

detecting a halt of the first water inflow via the flow switch;

detecting a second water inflow via the flow switch;

providing rinsing fluid to the discharge flow path through a rinse flow path of the ware washer upon the second detected water inflow, and halting the provision of rinsing fluid by blocking the discharge flow path; and detecting a halt of the second water inflow via the flow switch, wherein:

the step of providing washing fluid to the discharge flow path further comprises closing the rinse flow path;

the step of providing rinsing fluid to the discharge flow path further comprises closing the wash flow path;

the step of closing the rinse flow path comprises opening a wash flow solenoid of the wash flow path and closing a rinse flow solenoid of the rinse flow path; and the step of closing the wash flow path comprises closing the wash flow solenoid and opening the rinse flow solenoid.

18. The method of claim 17, wherein:

the steps of opening the wash flow solenoid and closing the rinse flow solenoid further comprise actuating a reverse relay of the ware washer; and the steps of closing the wash flow solenoid and opening the rinse flow solenoid further comprise actuating the reverse relay.

19. The method of claim 18, wherein:

actuating the reverse relay further comprises providing a signal from the flow switch to the reverse relay upon each detection of a new water inflow.

20. The method of claim 18, wherein:

actuating the reverse relay further comprises providing a signal from the flow switch to the reverse relay upon each detection of a new halt of water inflow.

* * * * *